United States Patent [19]

Stromquist

[11] Patent Number: 4,542,941

[45] Date of Patent: Sep. 24, 1985

[54] METHOD AND APPARATUS FOR CONVEYING SLURRY EXPLOSIVES

[76] Inventor: Donald M. Stromquist, 33 C St., Salt Lake City, Utah 84103

[21] Appl. No.: 570,630

[22] Filed: Jan. 13, 1984

Related U.S. Application Data

[63] Continuation of Ser. No. 329,229, Dec. 10, 1981, abandoned.

[51] Int. Cl.[4] ..... E21F 13/04

[52] U.S. Cl. ..... 299/12; 414/592

[58] Field of Search ..... 299/13, 10, 12; 166/77, 166/299; 137/613; 414/292, 293, 592; 254/334, 324; 222/1, 307, 310, 344, 358, 361, 362, 425, 434, 440, 450; 187/27, 20

[56] References Cited

U.S. PATENT DOCUMENTS

| | | | |
|---|---|---|---|
| 500,017 | 6/1893 | Long | 299/13 |
| 2,811,288 | 10/1957 | Willis | 222/310 |
| 3,134,437 | 5/1964 | Kappovich | 166/299 |
| 3,191,678 | 6/1965 | Hinson | 166/299 |
| 3,541,797 | 11/1970 | Stewart | 86/20 C |
| 4,127,151 | 11/1978 | Yeda et al. | 222/361 |

*Primary Examiner*—Stephen J. Novosad
*Assistant Examiner*—M. Goodwin
*Attorney, Agent, or Firm*—Mallinckrodt, Mallinckrodt, Russell & Osburn

[57] ABSTRACT

Flowable materials such as slurry explosives are transported down a mine shaft by providing a pipeline from the surface to the level in the mine where the material is needed. A plug is slidably and sealingly positioned within the pipeline and connected through a cable to a winch whereby the plug can be raised or lowered within the pipeline. With the plug near the top of the pipeline, material is loaded into the pipeline on top of the plug. The plug and material are then lowered to the desired depth in the mine and the material drained from the pipeline.

4 Claims, 2 Drawing Figures

METHOD AND APPARATUS FOR CONVEYING SLURRY EXPLOSIVES

This is a continuation of application Ser. No. 329,229, filed Dec. 10, 1981, now abandoned.

BACKGROUND OF THE INVENTION

1. Field

The invention is in the field of methods and apparatus for conveying flowable materials, such as slurry explosives, into a mine.

2. State of the Art

In many mining applications it is necessary or desirable to employ explosives to loosen the material being mined. In the past, when used in underground mining, explosives have been packaged and lowered in a service cage to the appropriate level, and then trucked to the appropriate location for use.

Attention has lately been directed toward the feasbility of mining oil shale in order to extract the oil contained therein. However, this will require the use of vast quantitites of explosives. Inasmuch as service cage time for uses such as lowering explosives into a mine is very limited, it is necessary to devise a new method to convey large amounts of explosives down a mine shaft to the point of use within a mine.

In recent years, various formulations of slurry explosives have been developed so that now this type of explosive is preferred for most uses. However, explosives in general, including slurry explosives, cannot safely be dropped over long vertical distances because of the danger of explosion on impact or the danger of alternation of physical or chemical properties on impact. Further, for similar reasons, a high hydrostatic head on the material is undesirable. Thus, it would be both unsafe and impractical to merely drop the explosives down a mine shaft, or to have the explosives completely fill a conduit extending down a mine shaft.

BRIEF SUMMARY OF THE INVENTION

The present invention provides a method and apparatus for safely transporting large quantities of slurry explosives into a mine without requiring use of cage time.

In accordance with the invention, a pipeline is fitted with a movable plug that is suspended in the pipeline from a cable. The plug is adapted to seal the pipeline, yet is free to slide up and down within the pipeline in response to lengthening or shortening of the cable. Slurry explosive is pumped into the pipeline on top of the plug to a predetermined depth, and the plug is lowered in the pipeline so as to lower the slurry. When the plug reaches the lower end of the pipeline, it passes a second pipeline communicating with the first pipeline. The slurry flows into the second pipeline and is directed into a holding tank or a tank truck in which it is taken to the blast site.

In this way, flow of the slurry in the pipeline is limited and impact at the bottom of the line is prevented. Further, the height of the slurry above the plug is controlled to prevent an excessive head causing excessive pressure on the slurry at the plug, i.e. at the bottom of the column of slurry in the pipeline.

THE DRAWING

In the accompanying drawing, which shows the best mode presently contemplated for carrying out the invention:

FIG. 1 is a fragmentary vertical section of a portion of a mine showing the invention in side elevation installed for use and showing the plug at its loading position; and FIG. 2, a perspective view of the installation of FIG. 1 showing the plug in the unloading position and the conveying pipe in section.

DETAILED DESCRIPTION OF THE ILLUSTRATED EMBODIMENT

Figure 1:
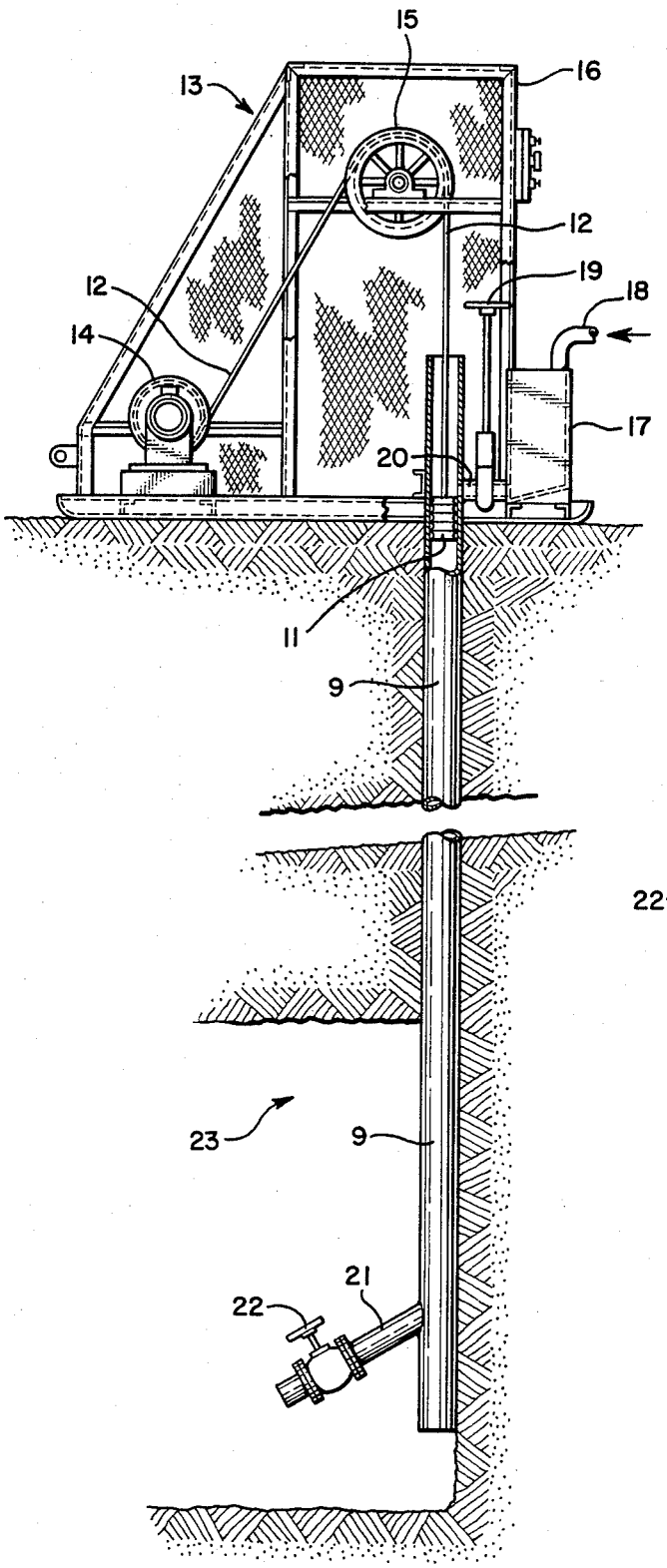
Figure 2:
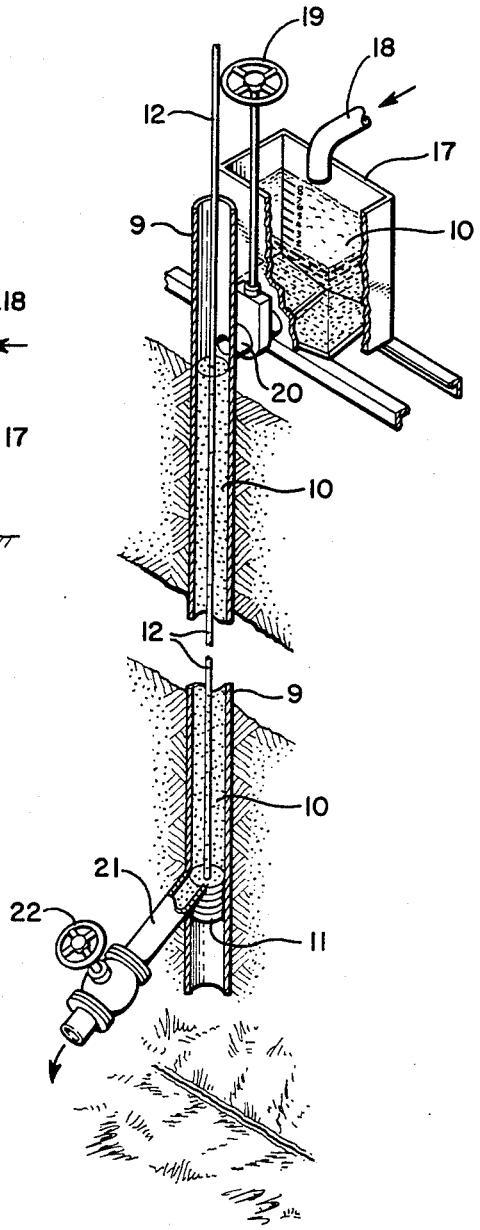

The present invention provides a safe, efficient, and convenient means for conveying large volumes of slurry explosive into a mine for use, without requiring use of a service cage.

As illustrated, a substantially vertical pipeline 9 is installed in the mine extending from the surface to the level underground where explosives are needed. The pipeline 9 should preferably have an inside diameter of between about 12" to 24" so that a substantial amount of slurry 10 can be conveyed. Of course, the pipeline may be hundreds of feet long. Although the pipeline may be constructed from various materials, it should be smooth on the interior and must be strong enough to hold the slurry therein. Also, it should be constructed of a material resistant to slurry ingredients so that it is not degraded by the slurry explosives which it carries. It is presently believed that a fiberglass pipeline is most suitable to meet these requirements.

In connection with the construction of the normal mine shaft, it is common to install a vertical pipeline between the surface and an underground tunnel so that concrete may be dropped to the tunnel level where needed. After construction of the shaft, such a pipeline may be conveniently adapted for use as pipeline 9 of the present invention.

A movable plug 11 is adapted to fit snugly inside pipeline 9 such that it effectively seals the pipeline when slurry is added above the plug. At the same time, the plug must be free to move within the pipeline. To hold plug 11 in position in the pipeline and to effect its movement therein, the plug is suspended by a cable 12. The cable is advantageously attached at its free end to a winch assembly 13 of well known construction comprising a winch 14 and a pulley wheel 15 secured to a supporting head frame 16.

The presently preferred embodiment is provided with a hopper 17, which is adapted to hold a measured volume of slurry. Slurry is pumped into hopper 17 through feed line 18 until the hopper is full. A valve 19 is conventiently provided in load pipe 20 which connects the hopper with pipeline 9, so that the hopper may be filled with slurry while a previously measured volume of slurry is being conveyed.

For loading the pipeline with slurry, plug 11 should be raised to a position slightly below the load pipe 20 as shown in FIG. 1. Valve 19 should then be opened, thus allowing slurry 10 to flow freely into pipeline 9. The upper end of pipeline 9 should extend somewhat above the top of hopper 17, so that slurry will not escape from the open end of pipeline 9 as it flows from the hopper into the pipeline. As plug 11 is lowered, the remaining slurry explosive contained in hopper 17 will flow into the pipeline and will be conveyed down the pipeline.

Once all of the slurry contained in hopper 17 has drained into pipeline 9, valve 19 may be closed and hopper 17 refilled for another load.

The lower end of pipeline 9 should be open, so that air contained in the pipeline below the plug may vent into the mine as the plug is lowered. THe upper end should likewise be open for venting and to accomodate movement of cable 12.

Near the bottom of pipeline 9, it is advantageous to provide a second pipeline 21 connected to pipeline 9 in a Y-configuration as illustrated. As plug 11 moves past the opening to pipeline 21, the slurry will flow into pipeline 21. A valve 22 near the end of pipeline 21 allows controlled unloading of slurry into a tank truck or other vehicle for transport within tunnel 23 to an area designated for use. If desired, pipeline 21 can be connected to a holding tank (not shown), from which the slurry is later transferred for use. It may be desirable to utilize pipe for pipeline 21 which has a smaller inside diameter than the inside diameter of pipeline 9 to insure that plug 11 will not inadvertantly enter pipeline 21.

Depending upon the diameter of pipeline 9, and the weight-bearing capacity of winch assembly 13 and cable 12, a large amount of slurry can be conveyed by each descent of plug 11. For instance, if pipeline 9 has an inside diameter of about 24", a one hundred foot column of slurry of a common slurry density of 1.2 would weigh about 12,000 lbs., and a pressure of about 52 p.s.i. would exist at the plug. If a one hundred foot column of slurry were carried in a 12" diameter pipe, the same 52 p.s.i. would exist at the plug, and almost 6000 pounds of slurry would be conveyed. As the cable 12 is lengthened, the combined weight of the plug and column of slurry resting on the plug in pipeline 9 will force the plug to move downwardly in the pipeline. This allows the use of a tightly fitting plug. After the slurry has been conveyed and removed from pipeline 9, winch 14 is used to pull the plug back to its loading position. Thus, the winch need be provided with only a brake to control the descent of the slurry and a motor sufficient to pull the plug back to the load position.

As the plug is raised to the load position, any slurry left on the side of pipeline 9 will be collected and brought back to the surface where it may either be removed or conveyed along with the next load of slurry. In addition, if desired, a wiper could be placed on the cable above the slurry to wipe the pipeline as the slurry is lowered.

If necessary, the system may be flushed with water or other solvent periodically to prevent buildup of dried slurry material.

While a loading hopper is shown so that a complete charge of slurry can easily be added as the plug moves downwardly, the hopper is not necessary and the slurry could be pumped directly into the pipe as the plug is being lowered. In such case, as in all cases of loading the slurry, the plug is lowered at the same rate as the slurry is pumped into the pipe or is allowed to flow into the pipe so that there is no drop of the slurry. After loading, the plug can be lowered at any speed determined safe for the slurry being used and may be gradually slowed as it reaches the bottom so as not to increase the pressure on the slurry at the bottom to an unsafe level.

Unloading of the slurry has been described as through pipeline 21; however, other means of unloading the slurry from pipeline 9 at its bottom could be used. For example, merely an opening or perforations in pipeline 9 may be provided at the bottom end thereof, so that when the plug 11 reaches the bottom of pipeline 9 the slurry flows out into a catch bin under the pipeline.

In a mining operation where slurry is needed on several levels of a mine, valved openings into pipeline 9 at the various levels could be provided. The plug 11 would be stopped at the approximate level and the slurry withdrawn through the opening.

The system has been described particularly for use with transporting slurry explosives, but could be used for transporting other hazardous or even non-hazardous materials where such materials cannot be merely dropped down the shaft. Material such as fuel oil for trucks or other mining equipment could be handled in this manner.

The system has been illustrated using a substantially vertical pipeline 9. However, it should be realized that a vertical pipeline is not necessary. It is only necessary that the pipeline be sloped enough so that the slurry and plug will slide downwardly therein.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. In combination with a mine having underground workings, apparatus for safely conveying a slurry explosive from ground surface to an underground location in said mine workings, comprising a pipeline extending from ground surface to said underground location and having an upper opening adjacent to ground surface for receiving the slurry explosive and at least one lower opening adjacent to the underground location for discharging the slurry; a plug slidably and sealingly fitted into said pipeline between said upper opening and said lower opening for movement downwardly and upwardly, and vice versa, therein; and means for moving said plug as specified, so explosive slurry loaded into said pipeline through said upper opening thereof can be safely lowered to said lower opening thereof.

2. The combination of claim 1, including a measuring hopper at the surface arranged for discharge into the upper opening of the pipeline.

3. A method of safely conveying a slurry explosive from ground surface to a location underground, comprising installing a pipeline from said ground surface to said underground location, said pipeline having an upper opening for receiving the slurry explosive and at least one lower opening for discharging the slurry; slidably and sealingly fitting a plug into said pipeline between the upper opening and said lower opening for movement downwardly and upwardly, and vice versa, therein; positioning said plug at a safe location in said pipeline; introducing a slurry explosive into said pipeline through said upper opening for pooling above said plug; and lowering said plug below said lower opening for discharge of the pooled slurry through said lower opening.

4. A method of safely conveying a slurry explosive from ground surface to a location underground according to claim 3, wherein the step of introducing a slurry explosive into the pipeline for pooling above the plug includes the step of moving the plug downwardly in the pipeline at a rate not greater than the rate that slurry explosive flows into the pipeline until the desired amount of explosive is positioned above the plug.

* * * * *